US006929510B2

(12) United States Patent
Pan

(10) Patent No.: US 6,929,510 B2
(45) Date of Patent: Aug. 16, 2005

(54) ELECTRICAL CONNECTOR WITH SHIELDING PLATE

(75) Inventor: Wei-Hua Pan, Kunsab (CH)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/927,829

(22) Filed: Aug. 27, 2004

(65) Prior Publication Data

US 2005/0048841 A1 Mar. 3, 2005

(30) Foreign Application Priority Data

Aug. 27, 2003 (CH) ..... 03278204

(51) Int. Cl.[7] ..... H01R 13/648
(52) U.S. Cl. ..... 439/607; 439/74
(58) Field of Search ..... 439/607, 74, 744

(56) References Cited

U.S. PATENT DOCUMENTS 5,174,771 A * 12/1992 Burgit et al. ..... 439/108
5,470,238 A * 11/1995 Walden ..... 439/98
5,863,222 A * 1/1999 Kinsey et al. ..... 439/607
5,915,976 A 6/1999 McHugh
5,921,814 A * 7/1999 Maruyama ..... 439/607
6,033,236 A 3/2000 McHugh et al.
6,086,421 A * 7/2000 Wu et al. ..... 439/607
6,135,816 A * 10/2000 Mashiyama ..... 439/607
6,322,394 B1 * 11/2001 Katoh et al. ..... 439/607
6,749,463 B1 * 6/2004 Fan ..... 439/607
6,780,055 B2 * 8/2004 Shinoura et al. ..... 439/607
6,790,088 B2 * 9/2004 Ono et al. ..... 439/607
2005/0032427 A1 * 2/2005 Hu et al. ..... 439/607

* cited by examiner

*Primary Examiner*—Ross Gushi
*Assistant Examiner*—Larisa Tsukerman
(74) *Attorney, Agent, or Firm*—Wei Te Chung

(57) ABSTRACT

An electrical connector (1) includes a dielectric housing (10), a number of terminals (20) received in the dielectric housing and a pair of shielding plates attached to outer faces of the side walls. The dielectric housing includes a mating face, a pair of side walls extending from the mating face and a mating space in the mating face between the side walls. Each side wall includes a pair of protrusions and a recess in the outer face thereof. Each terminal includes a contact portion exposed to the mating space. Each shielding plate is formed with a retention blade engaging with the pair of protrusions and a spring tang received in the recess for preventing the shielding plate from moving away from the mating face.

2 Claims, 4 Drawing Sheets

ELECTRICAL CONNECTOR WITH SHIELDING PLATE

BACKGROUND OF THE INVENTION

1. Field of the Invention

The present invention relates to an electrical connector, and particularly to an electrical connector having a shielding plate reliably retained in an dielectric housing thereof.

2. Description of Related Art

Board-to-Board connector assembly generally includes two matable connectors respectively mounted on two parallelly spaced printed circuit boards (PCB) to electrically connect these two PCBs for signal transmission therebetween. In some special applications, a large distance is required between the two spaced PCBs. A high profile board-to-board connector is accordingly developed to satisfy this requirement.

U.S. Pat. No. 6,033,236 discloses a high profile board-to-board connector comprising a dielectric housing, a plurality of terminals retained in the dielectric housing for signal transmission and a pair of shielding plates attached to the dielectric housing. The dielectric housing comprises a plurality of pairs of protrusions and a plurality of cutouts. Each shielding plate is formed with a plurality of retaining tabs and a plurality of grounding tabs facing the cutouts at an upper edge thereof. Each terminal comprises a horizontally extending tail portion located below and near a lower edge of the shielding plate. The retaining tabs movably engage with the pairs of protrusions for facilitating assembly of the shielding plate. When the connector mates with a complementary connector, some predetermined contacts of a complementary connector are received in the cutouts and mechanically contact with the grounding tabs. At the same time, the predetermined contacts of the complementary connector exert a force on the grounding tabs. Repeated mating between the connector and the complementary connector may drive the shielding plate to move downwardly and result in electrical connection between the shielding plate and the tail portions of the terminals, whereby the signal transmission cannot be ensured.

Hence, a high profile board-to-board connector with a shielding plate reliably retained thereto is desired to overcome the disadvantage of the prior art.

SUMMARY OF THE INVENTION

An object of the present invention is to provide an electrical connector with a shielding plate reliably assembled thereto for ensuring a good signal transmission thereof.

To achieve the above object, an electrical connector comprises a dielectric housing, a plurality of terminals received in the dielectric housing and a pair of shielding plates attached to outer faces of the side walls. The dielectric housing comprises a mating face, a pair of side walls extending from the mating face and a mating space in the mating face between the side walls. Each side wall comprises a pair of protrusions and a recess in the outer face thereof. Each terminal comprises a contact portion exposed to the mating space. Each shielding plate is formed with a retention blade engaging with the pair of protrusions and a spring tang received in the recess for preventing the shielding plate from moving away from the mating face.

Other objects, advantages and novel features of the invention will become more apparent from the following detailed description when taken in conjunction with the accompanying drawings.

DETAILED DESCRIPTION OF THE PREFERRED EMBODIMENT

Figure 1:
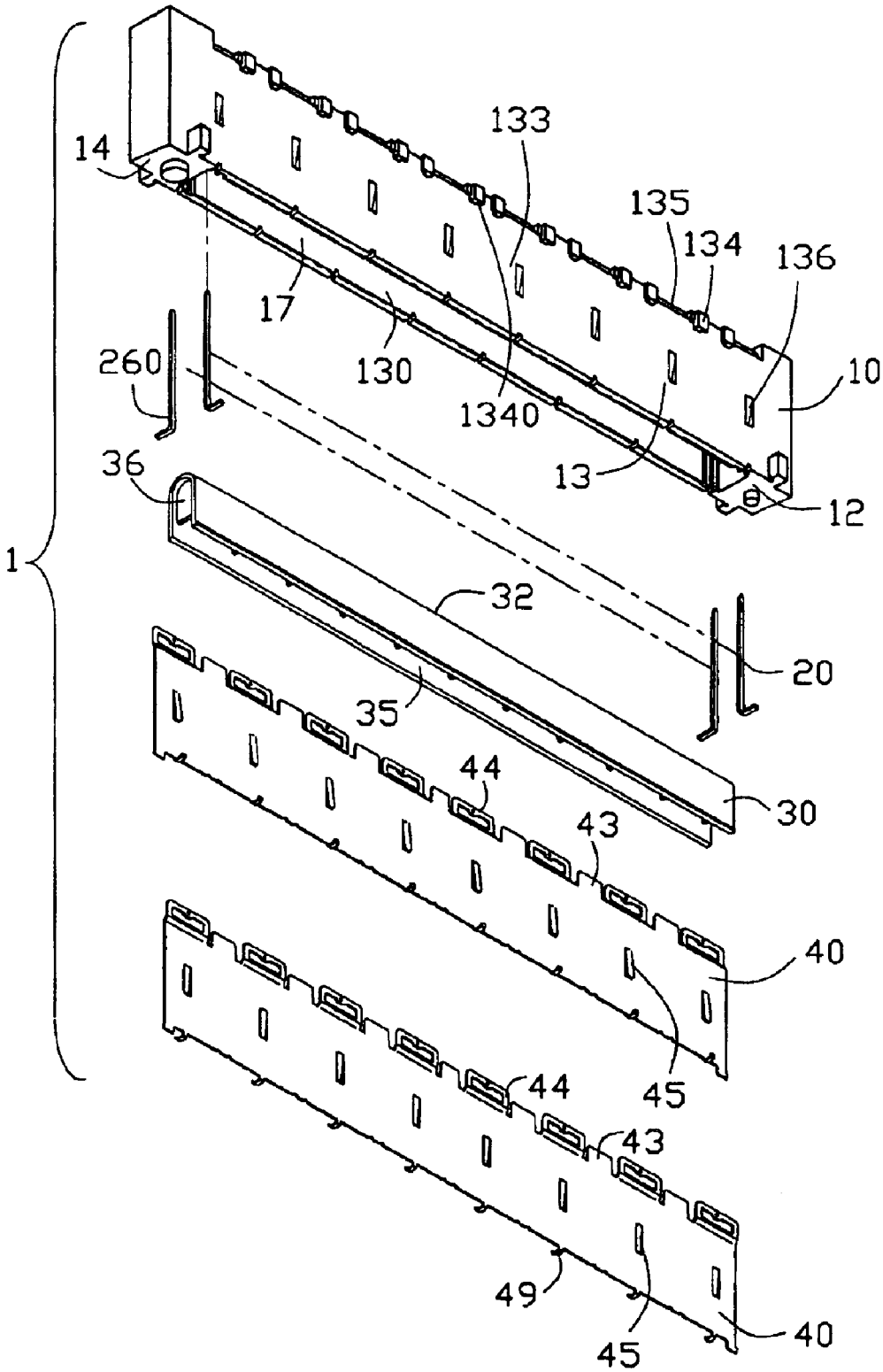
FIG. 1 is an exploded perspective view of an electrical connector in accordance with the present invention.
Figure 2:
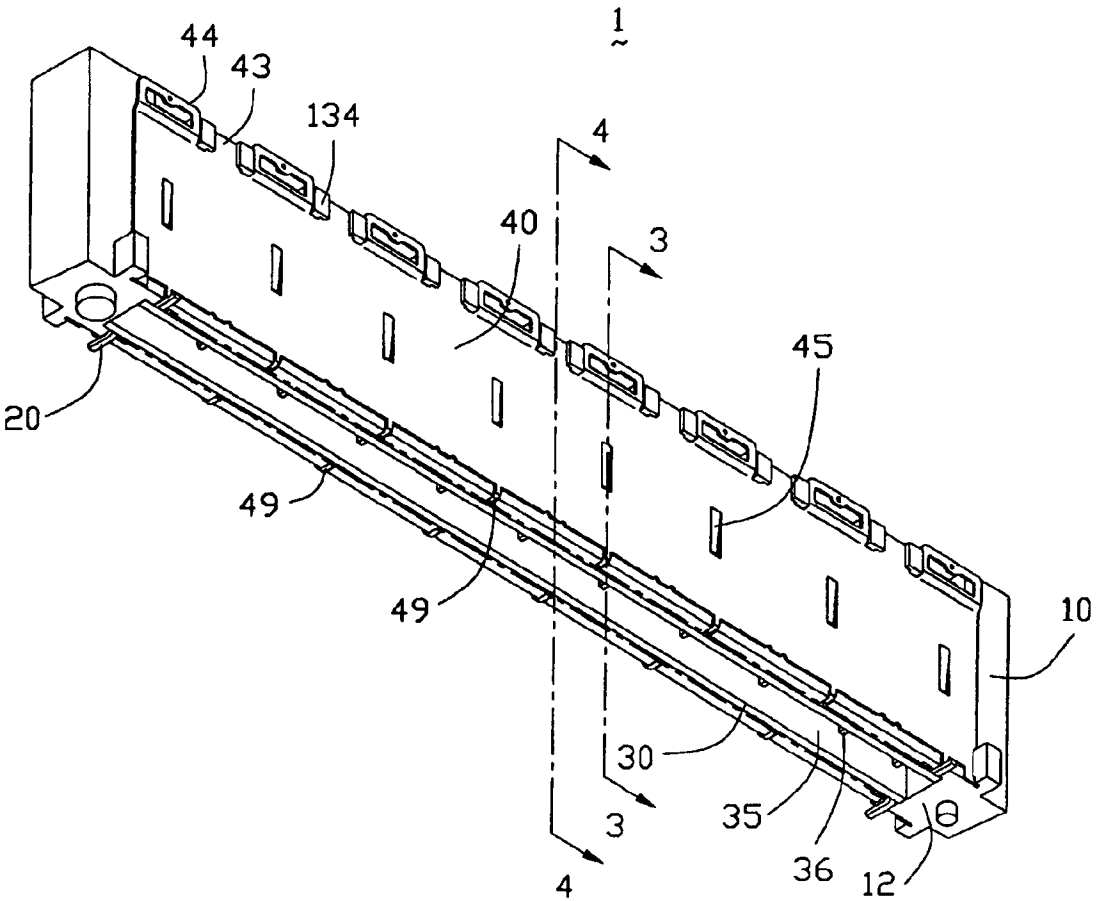
FIG. 2 is an assembled perspective view of the connector shown in FIG. 1.

Referring to FIGS. 1 and 2, an electrical connector 1 in accordance with the present invention comprises an elongate dielectric housing 10, a plurality of terminals 20 received in the dielectric housing 10, a spacer 30 adapted for positioning the terminals 20 and a pair of shielding plates 40 attached to the dielectric housing 10.

Figure 3:
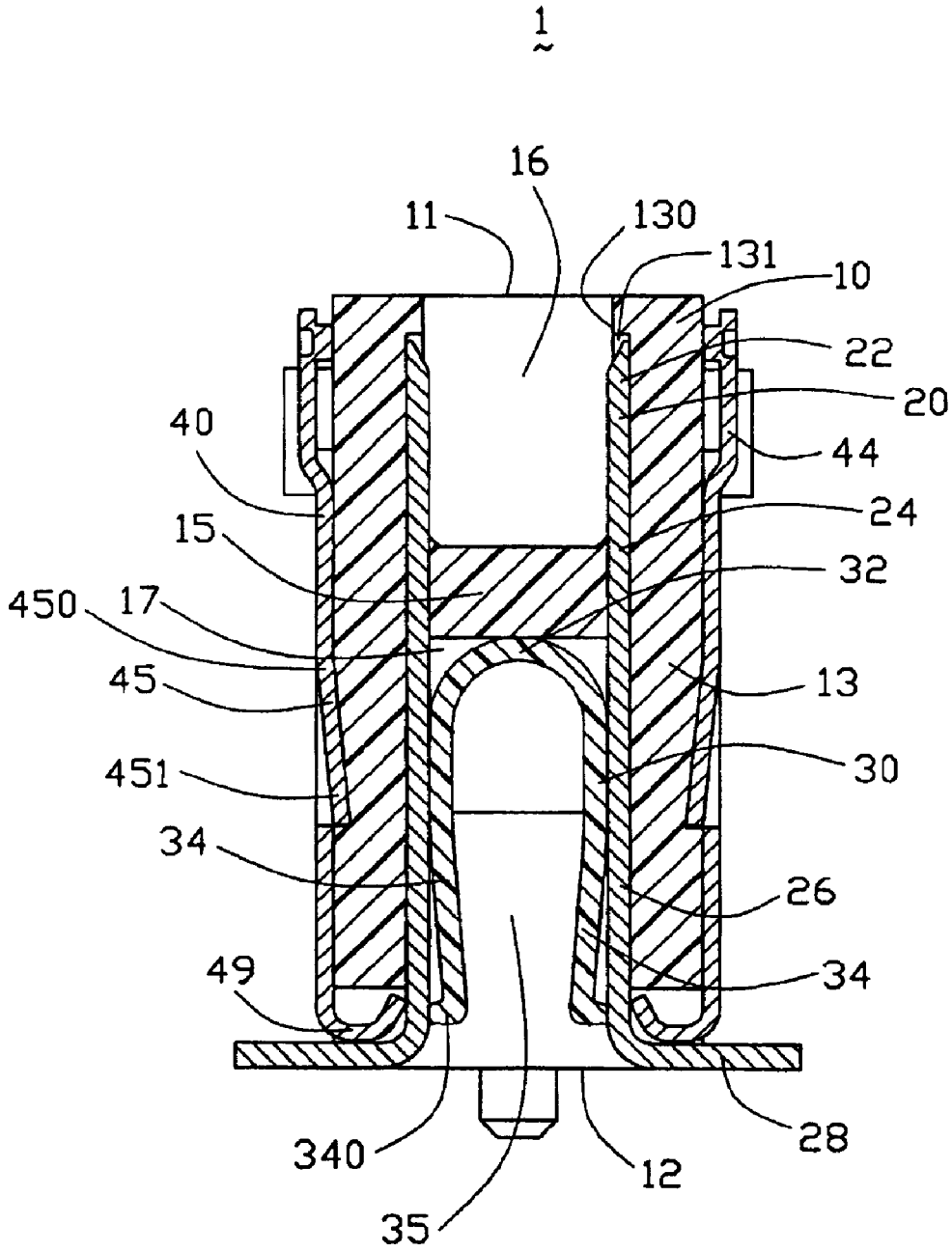
FIG. 3 is a cross-sectional view of the connector taken along line 3-3 of FIG. 2.

Referring to FIGS. 1 and 3, the dielectric housing 10 has a mating surface 11 and a mounting surface 12 opposite to the mating surface 11. Laterally spaced opposite side walls 13 and longitudinally spaced opposite end walls 14 extend between the mating surface 11 and the mounting surface 12, respectively. The dielectric housing 10 defines a mating space 16 in the mating surface 11 between the side walls 13 and a cavity 17 in the mounting surface 12 between the side walls 13. A clapboard 15 is formed between the mating space 16 and the cavity 17 and interconnects with the side walls 13 and the end walls 14. Each side wall 13 defines a plurality of passageways 131 in an inner face 130 thereof. Each passageway 131 comprises an upper section (not labeled) adjacent to the mating surface 11 and communicating with the mating space 16, an intermediate section (not labeled) passing through a joint of the side wall 13 and the clapboard 15, and a lower section (not labeled) adjacent to the mounting surface 12 and communicating with the cavity 17.

Referring to FIG. 1, the side walls 13 have a plurality of pairs of protrusions 134 and a plurality of cutouts 135 on an outer face 133 thereof adjacent to the mating face 11. Each pair of protrusions 134 is aligned and altenatively arranged with one cutout 135 along a lengthwise direction of the side wall 13. Each pair of protrusions 134 defines a pair of opposite slits 1340 in an inner side thereof. Each side wall 13 defines a plurality of recesses 136 located below the protrusions 134 and the cutouts 135 along the lengthwise direction thereof. The slits 1340 and the recesses 136 both extend along a mating direction of the electrical connector 1.

Figure 4:
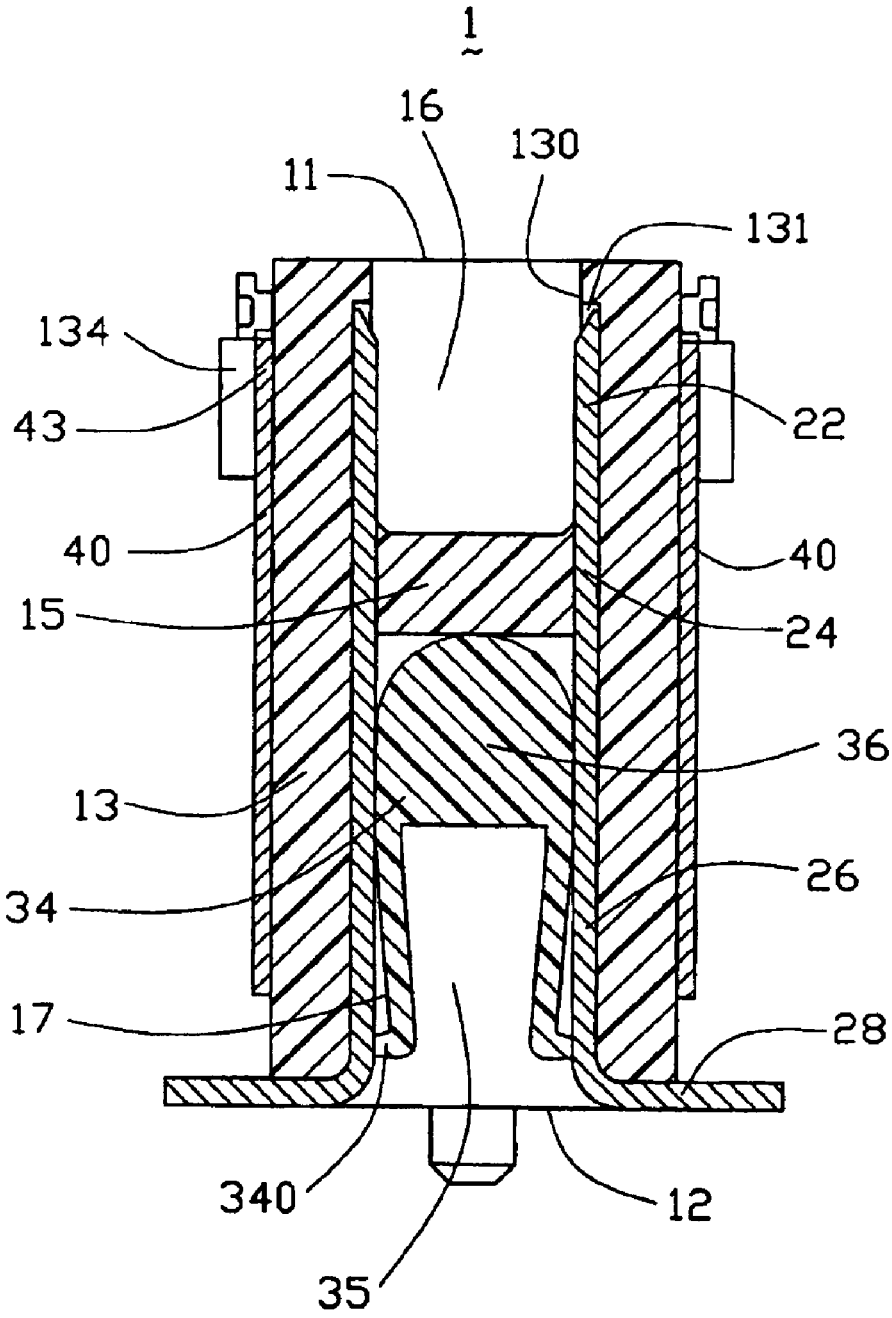
FIG. 4 is a cross-sectional view of the connector taken along line 4-4 of FIG. 2.

Referring to FIGS. 1, 3 and 4, each terminal 20 comprises a contact portion 22 received in the upper section of the passageway 131, a retaining portion 24 extending from the contact portion 22 and retained in the intermediate section of the passageway 131, a tail portion 26 extending from the retaining portion 24 and a solder portion 28 perpendicularly extending from the tail portion 26 for being surface mounted onto a printed circuit board (not shown). The tail portion 26 is formed with a pair of opposite barbs 260 adjacent to the solder portion 28 and is received in the lower section of the passageway 131 with the barbs 260 interferentially fitted in the passageway 131.

The shielding plates 40 are attached to the outer faces 133 of the side walls 13 for shielding purpose. Each shielding plate 40 comprises a plurality of retention blades 43 extending from an upper edge thereof. Each retention blade 43 engages with a corresponding pair of protrusions 134 with side edges thereof interferentially retained in the opposite slits 1340 of the pair of protrusions 134, whereby the retention blade 43 is restrictedly movable in the mating direction after being driven by an adequate force in order to facilitate assembly of the shielding plate 40. Each shielding plate 40 is formed with a plurality of spring tangs 45 stamped therefrom. Each spring tang 45 is received in a corresponding recess 136 for preventing the shielding plate 40 from moving downwardly in the mating direction. The retention blades 43 cooperate with the spring tangs 45 to secure the shielding plate 40 on the dielectric housing 10. The shielding plate 40 further comprises a plurality of grounding tangs 44 each positioned between every adjacent two retention blades 43 for facing to a corresponding cutout 135 which is adapted to receive a grounding contact of a complementary connector (not shown). A plurality of grounding pins 49 extends curvedly and inwardly from a bottom edge of the shielding plate 40 for electrically and mechanically connecting with the soldering tails 28 of predetermined terminals 20.

The desired position of the tail portions 26 relative to the housing 10 may not be reliable only by means of the barbs 260 due to an elongate suspending nature of the tail portion 26. The electrical connector 1 in accordance with the present invention is provided with a spacer 30 for securely positioning the terminal 20. As can be understood, the securely positioning applies whether the barbs 260 are formed on the tail portion 26. Referring to FIGS. 1, 3 and 4, the dimension of the spacer 30 is designed according to the dimension of the cavity 17. The spacer 30 has an elongated body with a U-shaped cross section. The spacer 30 comprises an arced intermediate portion 32 and a pair of laterally-spaced pressing portions 34 approximately parallelly extending downwardly from opposite ends of the intermediate portion 32 to define a chamber 35 therebetween. Each pressing portion 34 is formed with a projection 340 extending outwardly at a free end thereof. The spacer 30 is formed with a plurality of laterally extending strengthened ribs 36 connecting with the intermediate portion 32 and the pressing portion 34 for increasing the strength of the spacer 30. The ribs 36 are parallelly arranged along a lengthwise direction of the spacer 30 and are spaced from each other. The spacer 30 is assembled into the cavity 17 of the housing 10 with the intermediate portion 32 positioned adjacent to the clapboard 15. The tail portions 26 of the terminals 20 are tightly sandwiched between the projections 340 of the pressing portions 34 and the side walls 13 due to resilient deflection of the pressing portions 34. The terminals 20 are thus securely retained in the housing 10 thereby ensuring coplanarity of the solder portions 28 of the terminals 20. At the same time, the spacer 30 is interferentially retained in the cavity 17 of the dielectric housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a mating face, a pair of side walls and a mating space in the mating face between the side walls, each side wall defining a recess in an outer face thereof;

a plurality of terminals received in the dielectric housing and each comprising a contact portion exposed to the mating space; and a pair of shielding plates attached to the outer faces of the side walls and each formed with a spring tang received in the recess for preventing the shielding plate from moving away from the mating face;

wherein each side wall is formed with a pair of protrusions in the outer face thereof, and wherein each shielding plate is formed with a retention blade engaging with corresponding pair of protrusions;

wherein the protrusions define a pair of slits receiving the retention blade, and wherein the slits and the recess extend along a mating direction of the electrical connector;

wherein the protrusions are adjacent to the mating face and the recess is located below the protrusions;

wherein the spring tang is stamped from the shielding plate;

wherein the dielectric housing comprises a mounting surface and a cavity in the mounting surface between the side walls;

wherein each terminal comprises a tail portion exposed to the cavity, and a solder portion horizontally extending from the tail portion and located below a lower edge of corresponding shielding plate; and a spacer received in the cavity for positioning the terminals.

2. An electrical connector comprising:

a dielectric housing comprising a mating face, a pair of side walls and a mating space in the mating face between the side walls;

a plurality of terminals received in the dielectric housing and each comprising a contact portion exposed to the mating space; and a pair of shielding plates upwardly assembled to the outer faces of the side walls;

first interengagement means for securing the shielding plate to the corresponding side wall without relative movement along a lengthwise direction of the housing or in an upward direction; and second interengagement means for securing the shielding to the corresponding side wall without relative movement in a downward direction opposite to said upward direction;

wherein the first in interengagement means includes retention blades on an upper face of the shielding plate and protrusions on an upper face of the housing;

where in the second interengagement means includes tangs on the shielding plate and recesses in the side walls; and wherein the tangs are located on a middle portion of the shielding plate, and the recesses located in a middle portion of the side wall.

* * * * *